US005676118A

United States Patent [19]

Saito

[11] Patent Number: 5,676,118

[45] Date of Patent: Oct. 14, 1997

[54] FUEL VAPOR PURGE CONTROL SYSTEM OF AUTOMOBILE ENGINE

[75] Inventor: Yoichi Saito, Musashino, Japan

[73] Assignee: Fuji Jukogyo Kabushiki Kaisha, Tokyo, Japan

[21] Appl. No.: 711,985

[22] Filed: Sep. 10, 1996

[30] Foreign Application Priority Data

| | | | |
|---|---|---|---|
| Sep. 29, 1995 | [JP] | Japan | 7-252452 |
| Oct. 30, 1995 | [JP] | Japan | 7-281831 |
| Jun. 13, 1996 | [JP] | Japan | 8-152147 |

[51] Int. Cl.[6] ..... F02D 41/00

[52] U.S. Cl. ..... 123/679; 123/520

[58] Field of Search ..... 123/679, 520, 123/516, 518, 519, 682

[56] References Cited

U.S. PATENT DOCUMENTS

| | | | |
|---|---|---|---|
| 5,445,132 | 8/1995 | Isobe et al. | 123/516 |
| 5,445,133 | 8/1995 | Nemoto | 123/519 |
| 5,450,834 | 9/1995 | Yamanaka et al. | 123/520 |
| 5,460,136 | 10/1995 | Yamazaki et al. | 123/520 |
| 5,469,832 | 11/1995 | Nemoto | 123/682 |

FOREIGN PATENT DOCUMENTS

| | | | |
|---|---|---|---|
| 63-85249 | 4/1988 | Japan | 123/679 |
| 6146965 | 5/1994 | Japan | 123/679 |
| 6336940 | 12/1994 | Japan | 123/679 |

*Primary Examiner*—Raymond A. Nelli
*Attorney, Agent, or Firm*—Martin A. Farber

[57] ABSTRACT

A fuel vapor purge control system of an automobile engine comprises fuel vapor concentration calculating means for calculating a concentration of fuel vapor in the purge flow based on a feedback correction coefficient, target purge rate calculating means for selectively setting a target purge rate depending on the magnitude of the fuel vapor concentration, purge valve controlling means for controlling the operation of a purge control valve so as to obtain the target purge rate, purge condition judging means for judging whether or not a purge condition to perform purging is satisfied based on operational conditions of the engine, wherein the target purge rate calculating means sets an initial target purge rate after the purge condition judging means judges that the purge condition is satisfied, the initial target purge rate being gradually increased with an elapse of time from an initial rate to a predetermined rate, and then sets a target purge rate depending on the fuel vapor concentration after the initial target purge rate reaches a predetermined rate and correction means for correcting the fuel injection amount by reducing an amount equivalent to a purged fuel vapor amount calculated based on the fuel vapor concentration and the target purge rate. Whereby the controllability of the air-fuel ratio control system can be prevented from being lowered with the utmost evap purge amount retained.

15 Claims, 13 Drawing Sheets

FUEL VAPOR PURGE CONTROL SYSTEM OF AUTOMOBILE ENGINE

BACKGROUND OF THE INVENTION

1. Field of the Invention

The present invention relates to a fuel vapor purge control system of an automobile engine having a feedback controlled fuel injection control system.

2. Prior Arts

Modern automobiles, in general, are equipped with an evaporative emission control system for preventing fuel vapor generated in the fuel tank from being emitted into atmosphere. The evaporative emission control system includes a carbon canister for storing fuel vapor generated in the fuel tank and a purge control system in which this stored fuel vapor is purged together with air into the intake system of the engine through a purge control valve operated under a given purging condition of the engine. The purge control valve is, for example, a valve which controls the flow of mixture of air and fuel vapor (hereinafter referred to just as "evap") by the opening/closing operation based on the duty ratio determined according to specified engine operational conditions. As the specified engine operational conditions, an intake air amount, an intake manifold pressure and the like are often used. This is because since the purge flow of evap increases with a decrease of intake manifold pressure, it is convenient to use intake manifold pressure for the purge control of evap.

In the engine equipped with a purge control system as mentioned above, it must be taken into consideration that the fuel injection amount is corrected according to the evap purge amount when evap is introduced into the intake system of the engine. On the other hand, how to control an evap purge rate (rate of evap flow amount to intake air amount) has an adverse effect on the air-fuel control of the engine.

Japanese Unexamined Patent Application Toku-Kai-Hei No. 6-146965 and Toku-Kai-Hei No. 6-336940 disclose techniques in which at the start of purging, in addition to that the purge rate is gradually increased, an increase of the purge rate is suppressed when it is judged from an output of an air-fuel sensor that the air-fuel ratio is becoming rich and the estimation speed of the evap concentration in the purge flow of evap is increased so as to correct the fuel injection amount more properly and so on.

Since the purge control techniques of the prior arts as described above are based upon the air-fuel ratio feedback control through the detection of the air-fuel ratio sensor, it is unavoidable that there is a time delay in detecting the change of air-fuel ratio. Therefore, it is very difficult to expect an accurate purge control, especially at the initial stage of the purge control. Further, even after the initial stage of the purge control, for example, under the transient condition of the engine operation, it is difficult to maintain a proper air-fuel ratio control.

Furthermore, in recent years, evaporative emission standards are becoming more and more stringent and therefore evaporative emission control system must have a capability of processing a large amount of fuel vapor. In order to process as much fuel vapor as possible, it is necessary to raise a purge rate which is a rate of purge flow amount to intake air amount to a high level as far as possible within a range capable of retaining a feedback control of the air-fuel ratio and to purge fuel vapor keeping that high level of the purge rate.

However, starting to purge the large amount of evap regardless of the charging condition of the canister may cause an excessive rich condition of air-fuel ratio in case where fuel vapor is fully stored in the canister and on the other hand may cause an excessively lean condition of air-fuel ratio in case where fuel vapor is less stored. This makes it difficult to realize a stoichiometric control of air-fuel ratio and brings an adverse effect on the controllability of the system.

Further, it is necessary to realize a proper air-fuel ratio control or a stoichiometric control of the engine even in such a situation that when fuel temperature goes up and the amount of fuel vapor is increased, the rich fuel vapor flows directly into the engine without passing through the canister.

SUMMARY OF THE INVENTION

Accordingly, the present invention is intended to obviate the disadvantages of the known purge control system and it is an object of the present invention to provide a purge control system capable of purging an enough amount of evap not only at the initial stage but also at each of subsequent stages with a proper air-fuel ratio control retained. It is another object of the present invention to provide a purge control system capable of processing a large amount of evap without having an adverse effect on the air-fuel ratio control of the engine.

In order to achieve the above objects, the fuel vapor purge control system according to the present invention comprises:

- fuel vapor concentration calculating means for calculating a concentration of fuel vapor in the purge flow based on a feedback correction coefficient;
- target purge rate calculating means for selectively setting a target purge rate depending on the magnitude of the fuel vapor concentration;
- purge valve controlling means for controlling the operation of a purge control valve so as to obtain the target purge rate;
- purge condition judging means for judging whether or not a purge condition to perform purging is satisfied based on operational conditions of the engine, wherein the target purge rate calculating means sets an initial target purge rate after the purge condition judging means judges that the purge condition is satisfied, the initial target purge rate being gradually increased with an elapse of time from an initial rate to a predetermined rate, and then sets a target purge rate depending on the fuel vapor concentration after the initial target purge rate reaches a predetermined rate; and
- correction means for correcting the fuel injection amount by reducing an amount equivalent to a purged fuel vapor amount calculated based on the fuel vapor concentration and the target purge rate.

DETAILED DESCRIPTION OF THE PRESENT INVENTION

Figure 1:
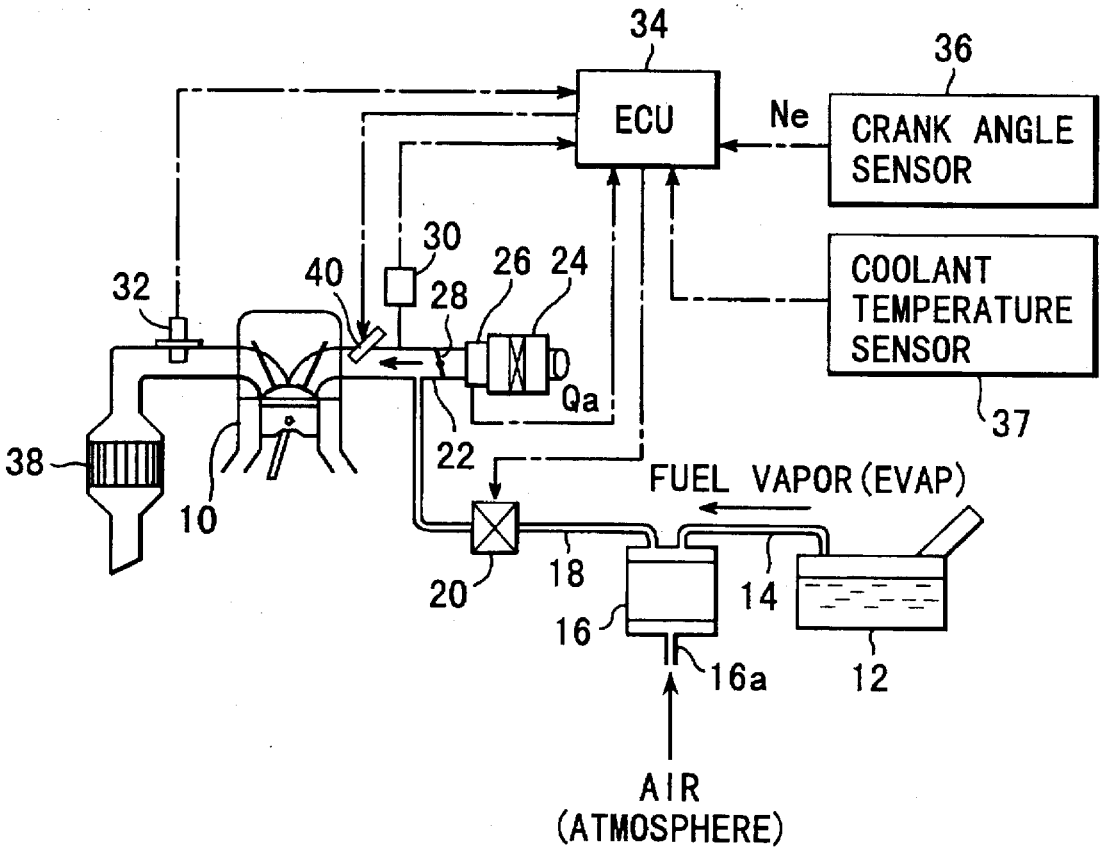
FIG. 1 is a schematic drawing showing an evap purge control system according to the present invention.

Referring now to FIG. 1, an evap conduit 14 is disposed at a fuel tank 12 to introduce evap to a canister 16. A purge passage 18 is connected with the canister 16 to purge evap and the purge passage 18 is connected with an intake manifold 22 of an engine 10 through a purge solenoid valve 20.

An airflow meter 26 is provided at the upstream portion of the intake manifold 22 and further an air cleaner 24 is provided upstream of the airflow meter 26. Downstream of the airflow meter 26, there is provided with a throttle valve 28 and a pressure sensor 30 is disposed between the engine 10 and the throttle valve 28 to detect a pressure inside of the intake manifold 22. On the other hand, there is provided with an $O_2$ sensor 32 acting as an air-fuel ratio sensor in an exhaust system of the engine 10.

An engine control unit (hereinafter referred to as "ECU") 34 performs miscellaneous controls on engine related devices based on output signals from miscellaneous sensors. In this embodiment, an air-fuel ratio signal from the $O_2$ sensor 32, an intake manifold pressure $P_b$ from the pressure sensor 30, an intake air amount $Q_a$ from the airflow meter 26, and an engine revolution speed $N_e$ from a crank angle sensor 36, those signals are inputted to the ECU 34.

From the ECU 34 a control signal is outputted to the purge solenoid valve 20 and the fuel injector 40 to perform the opening/closing control and the fuel injection control respectively. In FIG. 1, numeral 16a denotes an air inlet disposed in the canister 16 and air introduced through this air inlet 16a is purged together with fuel vapor stored in the canister 16 to the intake manifold 22 when the purge solenoid valve 20 is opened. Numeral 37 presents a coolant temperature sensor 37 which is provided in the engine 10. The temperature data detected by the coolant temperature sensor 37 is outputted to the ECU 34. Further, numeral 38 denotes a catalytic converter which is provided in the exhaust passage of the engine 10.

Figure 2:
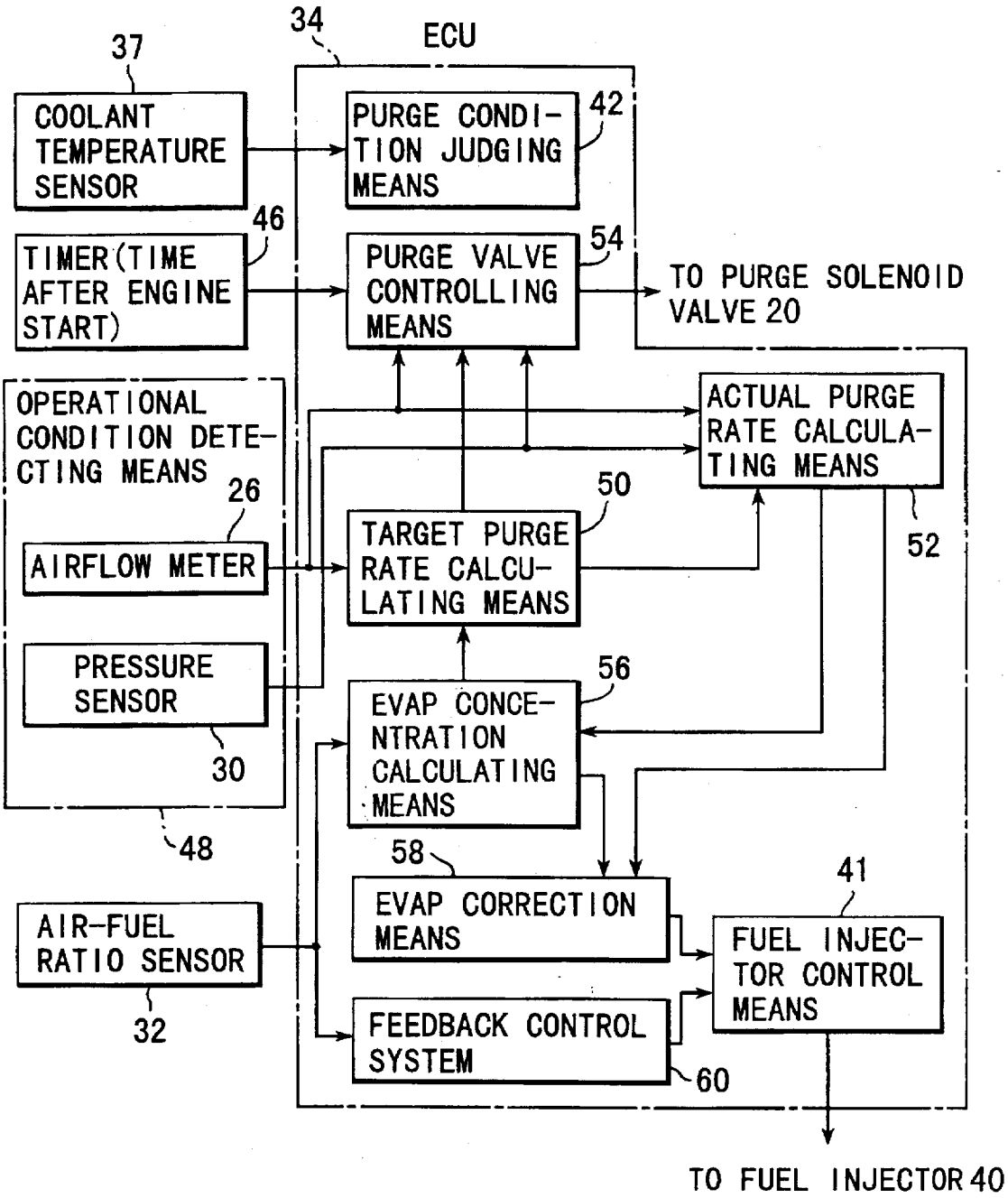
FIG. 2 is a block diagram showing an evap purge control system according to the present invention.

Referring to FIG. 2, the brain of the purge control system associated with the present invention is contained in the ECU 34. In which, a purge condition judging means 42 makes a judgment as to whether the purging should be performed or not based on signals from the coolant temperature sensor 37, a timer 46 for measuring an elapsed time since the engine starting and based on signals from an operational condition detecting means 48 comprising the airflow meter 26, the pressure sensor 30 and the like.

A target purge rate calculating means 50 calculates a target purge rate which is a ratio of the evap purge amount versus the intake air amount of the engine based on detected signals from the operational condition detecting means 48, among which a signal of the intake air amount Qa from the airflow meter 26 plays an important role in this embodiment.

An actual purge rate calculating means 52 calculates an actual purge rate $P_{RTOR}$, i.e., a purge rate of the evap actually purged, on the basis of the target purge rate $P_{RTO}$ calculated in the target purge rate calculating means 50, the intake air amount $Q_a$ and the intake manifold pressure.

More specifically, the actual purge rate $P_{RTOR}$ is calculated according to the formula $P_{RTOR}=P_{VRTO}*P_{RTO}$, where $P_{VRTO}$ is a flow acquisition coefficient which is read from a two-dimensional map parameterizing the target purge amount (=intake air amount $Q_a$*target purge rate $P_{RTO}$) and the intake manifold pressure. This flow acquisition coefficient map is prepared beforehand from experiments on the target engine, in consideration of a case where the actual evap flow does not reach the target value, depending upon the characteristic of the purge solenoid valve 20.

A purge valve controlling means 54 makes a duty control so as to perform an evap purge based on a signal from the purge condition judging means 54 and on a signal of the target purge rate $P_{RTO}$ outputted from the target purge rate calculating means 50. The duty ratio $C_{PCD}$ for controlling the purge solenoid valve 20 is calculated according to the formula $C_{PCD}=C_{PCDMAP}+C_{PCDO}$, where $C_{PCDMAP}$ is a value obtained from a two-dimensional map parameterizing the target purge amount and the intake manifold pressure and $C_{PCDO}$ is an invalid duty ratio, considering the characteristic of the duty solenoid valve. The target purge amount is obtained by multiplying the intake air amount $Q_a$ by the target purge rate $P_{RTO}$.

The calculation of the duty ratio $C_{PCD}$ is not limited to the foregoing. For example, where the target purge rate calculating means 50 selectively sets one of some target purge rates $P_{RTOS}$, a duty ratio $C_{PCD}$ may be retrieved from a two-dimensional duty ratio map which is prepared for each target purge rate $P_{RTOS}$, depending upon the parameters of the load (basic fuel injection amount $T_p$, intake air amount Q, intake air pressure P, etc) and the engine speed $N_e$.

As a further example of the calculation of the duty ratio $C_{PCD}$, a duty ratio $C_{PCD}$ may be obtained by correcting a map value $C_{PCMAP}$ retrieved from a basic duty ratio map by a coefficient $P_{RTOLMD}$ representative of a target purge rate $P_{RTOS}$ calculated by the target purge rate calculating means 50, according to the following equation.

$$C_{PCD}=C_{PCMAP}*P_{RTOLMD}$$

The basic duty ratio map is characterized by the engine load (basic fuel injection amount $T_p$, intake air amount Q, intake air pressure P, etc) and the engine speed. Each basic duty ratio contained in the map is fixed so as to perform purging in a specific purge rate.

An evap concentration calculating means 56 calculates an evap concentration based on a first-order delay value of the feedback correction coefficient LAMBDA controlling the fuel injection amount. Details will be described hereinafter.

Finally, an evap correction means 58 performs a feedforward correction of the fuel injection amount based on the evap concentration signal from the evap concentration calculating means 56 and on the actual purge rate signal from the actual purge rate calculating means 52. A signal for correcting the fuel injection amount is outputted from the evap correction means 58 to an injector control means 41 which also performs the correction of the fuel injection amount by a signal from the feedback control system 60.

The evap purge control system according to the present invention is characterized by dividing into three stages the purging processes from the purge starting, through the purge stop to the purge restarting. These purging processes will be described hereinafter according to the attached flowcharts.

Figure 3:
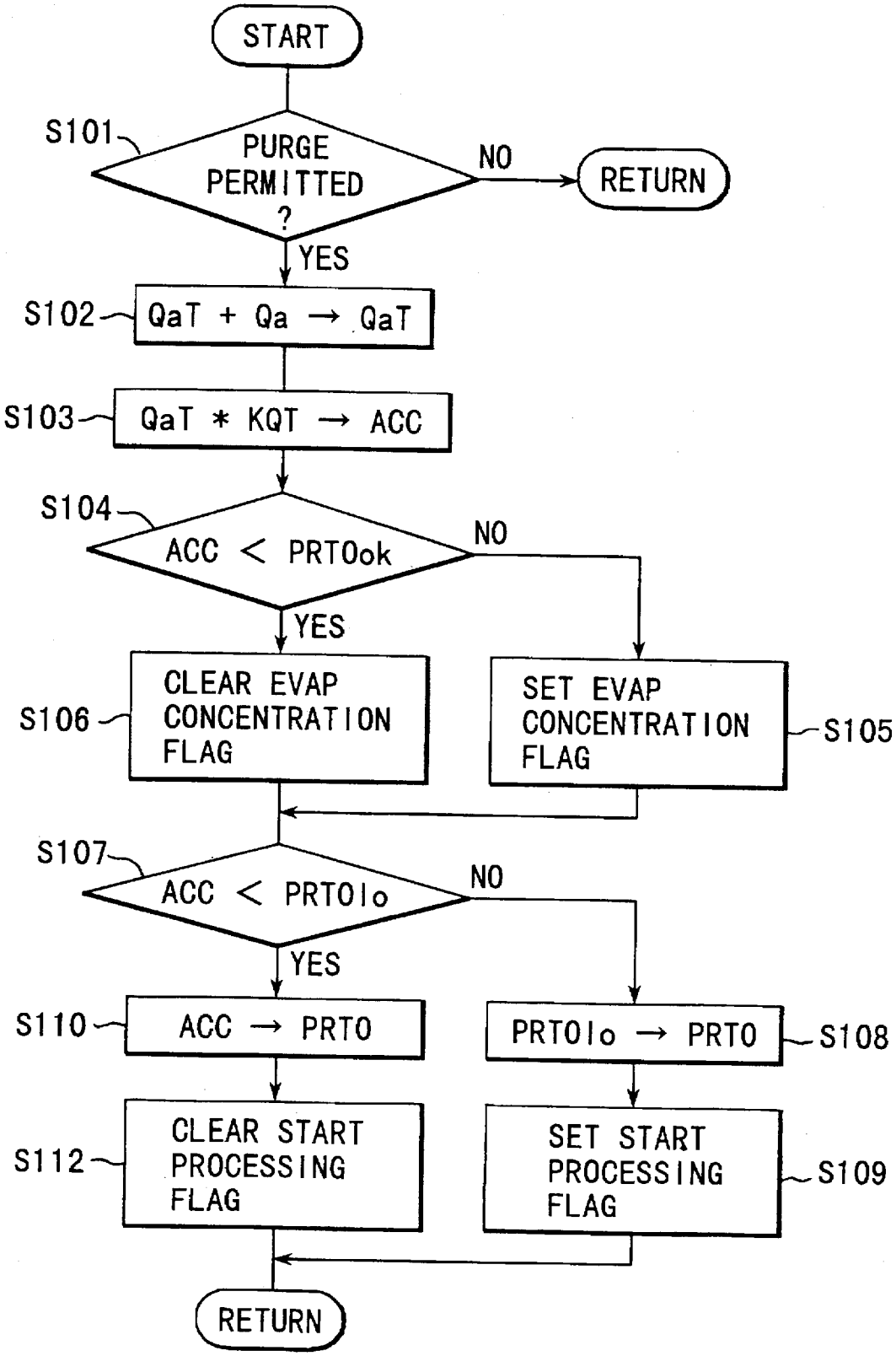
FIG. 3 is a flowchart showing a first example of a routine for calculating a target purge rate at the start of purging according to the present invention.
Figure 8:
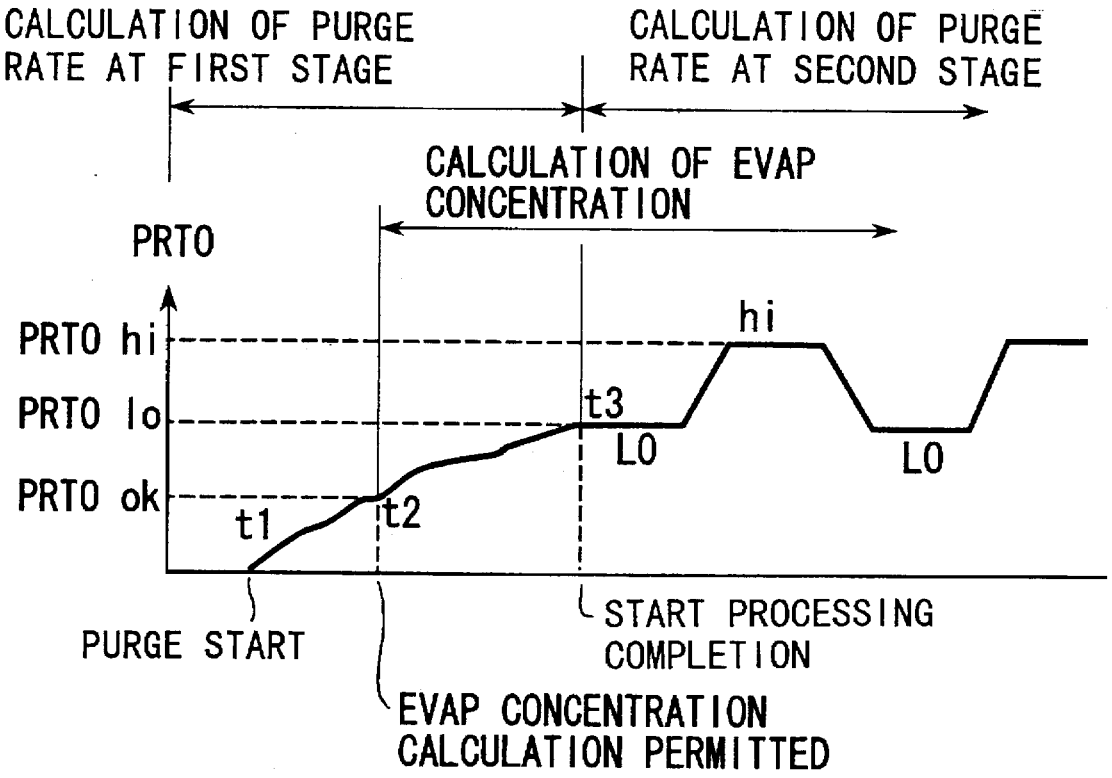
FIG. 8 is a time chart showing a change of a target purge rate obtained from an embodiment of the present invention.

Referring now to FIG. 3, this flowchart indicates a first calculating routine for calculating the initial target purge rate at the first stage (from the purge start to the start processing completion as shown in FIG. 8).

At a step (hereinafter referred to as just 101, it is judged whether or not the purge permission condition is satisfied. If the purge permission condition is not satisfied, the program is returned to START and if it is satisfied, the program goes to S102 where an accumulated value of the intake air amount is calculated, namely, an accumulated value $Q_{aT}$ of the intake air amount after the purge permission is calculated.

After that, at S103 the accumulated value $Q_{aT}$ is multiplied by a coefficient $K_{QT}$ which is a coefficient established to calculate a target purge rate. Thus obtained target purge rate $P_{RTO}$ is stored in the RAM of the ECU 34 as an accumulator (hereinafter referred to as ACC). Since this routine is executed by a periodic interruption process, the target purge rate $P_{RTO}$ is increased with an increase of the accumulated value $Q_{aT}$. A present target purge rate is stored as ACC in this flowchart.

Next, at S104 it is judged whether or not the present target purge rate $P_{RTO}$ stored as ACC exceeds a specified value $P_{RTOok}$ that is a reference purge rate for determining the start of the calculation of the evap concentration. If ACC is equal to or larger than the specified value (NO), a flag for permitting the evap concentration calculation is set at S105 and if ACC is smaller than the specified value (YES), the program steps to S106 where the flag for permitting the evap concentration calculation is cleared.

Next, at S107 it is judged whether or not the present target purge rate (ACC) is larger than a maximum purge rate $P_{RTOlo}$. If ACC is equal to or larger than $P_{RTOlo}$ (NO), at S108 the maximum purge rate $P_{RTOlo}$ is set to the target purge rate $P_{RTO}$ to maintain this maximum purge rate $P_{RTOlo}$ at the low reference value. That is, the calculation of the target purge rate has an upper limit of the maximum purge rate $P_{RTOlo}$. Then, the program goes to S109 in which the target purge rate reaches the maximum purge rate and a start processing flag is set to indicate a finishing of the start process.

On the other hand, if ACC is smaller than $P_{RTOlo}$ (YES), at S110 the present target purge rate ACC is set to the target purge rate $P_{RTO}$ and further at S112 the start processing flag is cleared or that state is maintained. This start processing flag acts as a condition to execute the periodic interruption routine. That is, if this flag is cleared, the periodic interruption routine is executed.

According to the first target purge rate calculating routine, since the target purge rate $P_{RTO}$ is calculated on the basis of the accumulated intake air amount $Q_a$ without using measuring values having a time delay, such as the measured air-fuel ratio value, the measured evap concentration value and the like.

Next, a second calculating routine of the target purge rate at the first stage will be described with reference to FIG. 4. The description of steps S201 and S202 will be omitted because they are the same as S101 and S102 of FIG. 3. At S203, it is judged whether or not the accumulated intake air amount $Q_{aT}$ after the start of purging exceeds a specified value $Q_{aTO}$. If it does not (NO), the program is returned to START and if it does (YES), at S204 a product of the subtraction $Q_{aT}-Q_{aTO}$ is set as a new accumulated intake amount $Q_{aT}$. Then, at S205 an increment of the target purge rate $\Delta P_{RTOO}$ is added to the target purge rate $P_{RTO}$ and the product thereof is set to ACC as the present target purge rate. Thus, in this routine, each time the accumulated intake air amount is increased by a specified value, the target purge rate is made increased by a specified increment.

The processes from S206 to S213 are the same as those from S104 to S112 and therefore the description about these steps will be omitted. That is, at the steps S206 through S213, the flag for permitting the evap concentration calculation is set or cleared, or the target purge rate set to the maximum purge rate.

Figure 5:
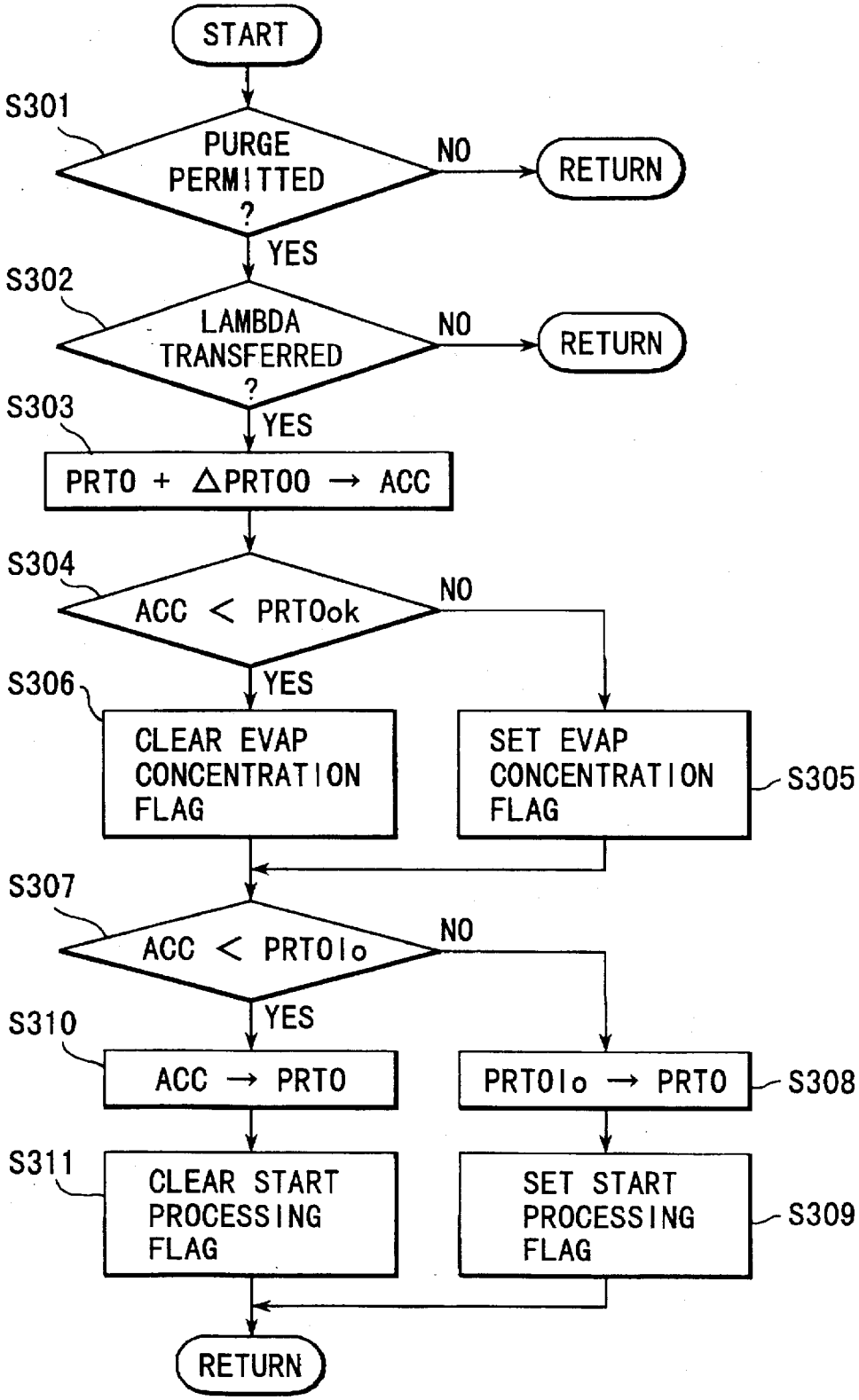
FIG. 5 is a flowchart showing a third example of a routine for calculating a target purge rate at the start of purging according to the present invention.

FIG. 5 shows a third calculating routine of the target purge rate at the first stage. In which, at S301 it is judged whether or not the purge is permitted and if it is not permitted (NO), the program is returned to START. If it is permitted (YES), at S301 it is judged whether or not the feedback correction coefficient LAMBDA determined based on the output of the air-fuel ratio sensor is transferred from rich to lean. If LAMBDA is not transferred (NO), the program returns to START and if LAMBDA is transferred (YES), at S303 a predetermined increment of the target purge rate $\Delta P_{RTOO}$ is added to the previous target purge rate $P_{RTO}$ and the product of this is stored in ACC as a new target purge rate. That is to say, each time the feedback correction coefficient LAMBDA is transferred from rich to lean, the target purge rate is increased by an increment $\Delta P_{RTOO}$. Operations from S304 to S311 should be allowed to be omitted from description because of the same processes as the steps S104 and after in FIG. 3.

This embodiment enables the purge amount to increase with relationship to the result of the air-fuel ratio detection and hence an effect of purging on the air-fuel ratio can be minimized. Further, this process of just detecting the feedback coefficient LAMBDA simplifies the control of the system when purging is carried out.

Figure 6:
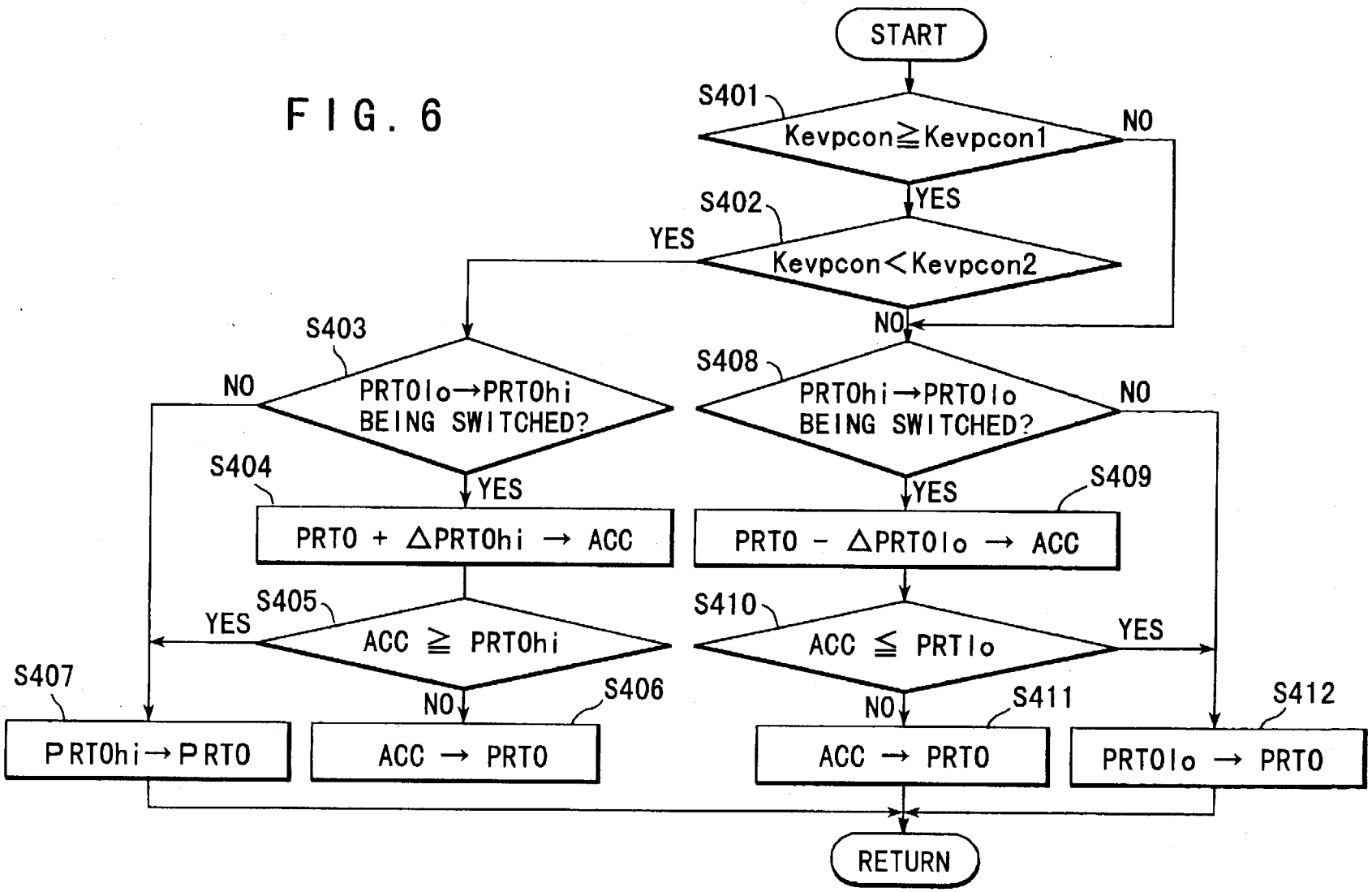
FIG. 6 is a flowchart showing a first example of a routine for calculating a target purge rate before the end of purging according to the present invention.

Next, FIG. 6 indicates a first calculating routine of the target purge rate at the second stage after the permission of the evap concentration calculation and before the stop of purging.

Figure 4:
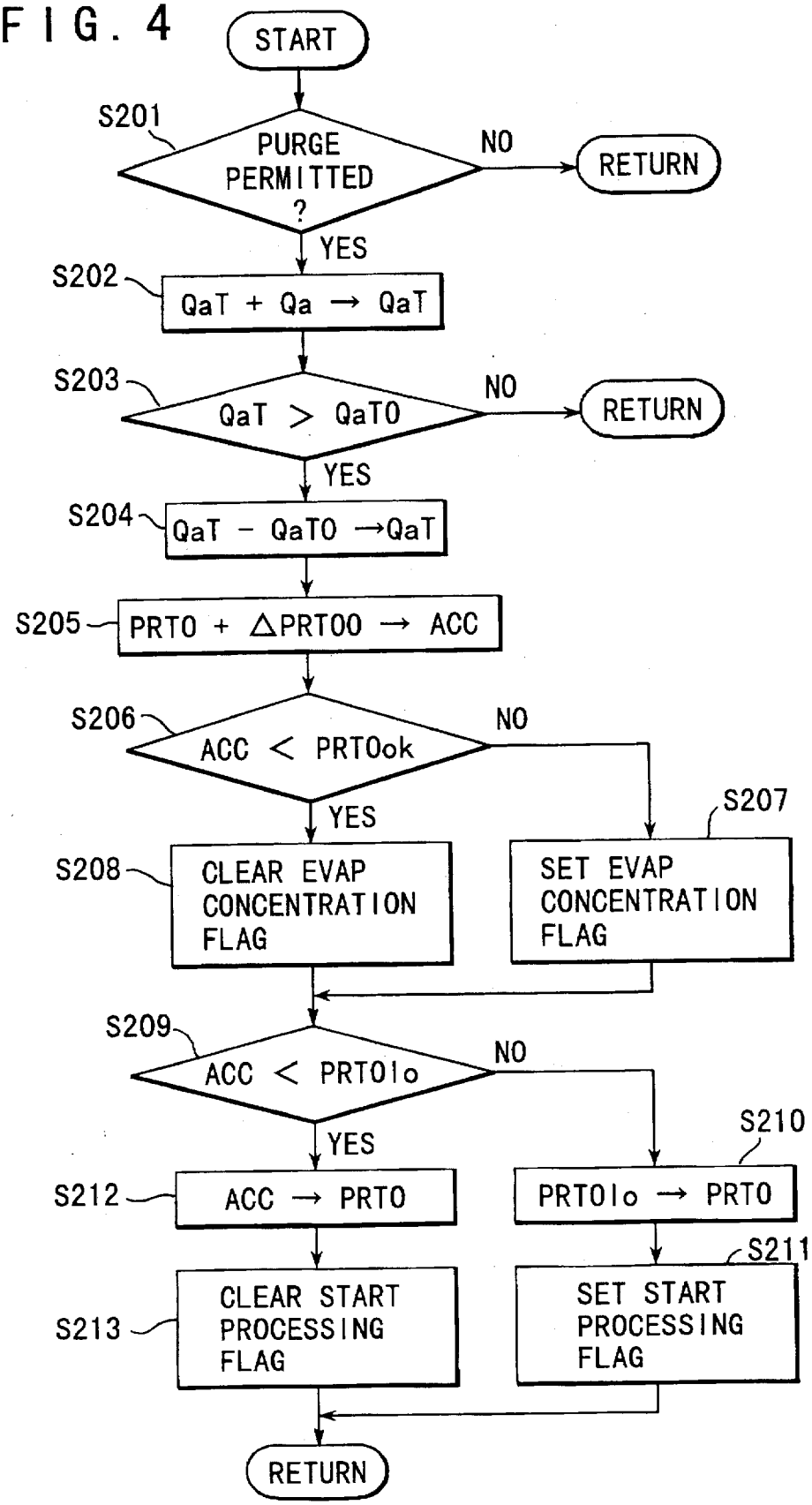
FIG. 4 is a flowchart showing a second example of a routine for calculating a target purge rate at the start of purging according to the present invention.

This routine is executed under the condition that the evap concentration calculation permitting flag is set and the start processing flag is also set in the routines of FIG. 3, FIG. 4 and FIG. 5. That is, this routine is executed when the calculation of the evap concentration is being carried out and the target purge rate is set to the maximum purge rate $P_{RTOlo}$.

First, at S401 it is judged whether or not an evap concentration coefficient $K_{evpcon}$ which will be described hereinafter is larger than a predetermined first evap concentration reference coefficient $K_{evpcon1}$. Further, at S402 it is judged whether or not the evap concentration coefficient Kevpcon is smaller than a predetermined second evap concentration reference coefficient $K_{evpcon2}$. If these both conditions are satisfied (YES), this indicates that the present evap concentration is within a specified reference range and that the target purge rate is set to a higher purge rate $P_{RTOhi}$. On the other hand, if either condition of S401 or S402 is not satisfied, the target purge rate is set to a lower purge rate $P_{RTOlo}$.

Figure 7:
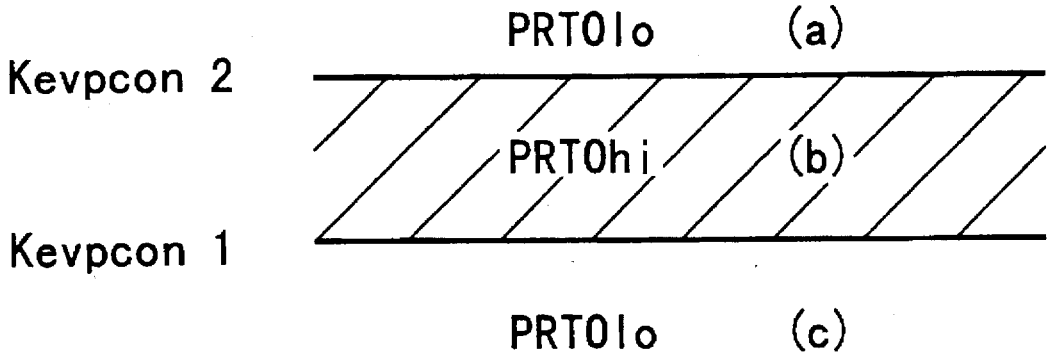
FIG. 7 is an explanatory drawing showing an area of the evap concentration.

If it is judged that the present evap concentration coefficient is larger than the first evap concentration reference coefficient $K_{evpcon1}$ and is smaller than the second evap concentration reference coefficient $K_{evapcon2}$, the high purge rate $P_{RTOhi}$ is introduced. Referring to FIG. 7, the present evap concentration is within a hatched area (b). of the evap concentration area. In this case, at S403 it is judged whether or not the purge rate is being switched from the low purge rate to the high purge rate. If the purge rate is being switched to the high purge rate, at S404 an increment $\Delta P_{RTOhi}$ is added to the previous target purge rate $P_{RTO}$ and the product thereof is as a new target purge rate stored in ACC. Further, at S405 it is judged whether or not the new purge rate exceeds the high purge rate $P_{RTOhi}$. If it does not exceed $P_{RTOhi}$ (NO), at S406 the target purge rate (ACC) is established as the present target purge rate $P_{RTO}$. On the other hand, at S405 if the added target purge rate is larger than the high purge rate $P_{RTOhi}$ (YES), the program goes to S407 where the high purge rate $P_{RTOhi}$ is established as the target purge rate $P_{RTO}$. That is, the increment $\Delta P_{RTOhi}$ is added to the previous target purge rate step-by-step until the target purge rate $P_{RTO}$ is equal to or larger than the high purge rate $P_{RTOhi}$ and when the target purge rate reaches the high purge rate $P_{RTOhi}$, the high purge rate $P_{RTOhi}$ is established as the target purge rate.

Further, when it is judged at S403 that the switching from $P_{RTOlo}$ to $P_{RTOhi}$ is finished (NO), that is when it is judged that the target purge rate has been already established to the high purge rate $P_{RTOhi}$, the program skips to S407.

In case where the judgment is NO at S401 or S402, namely, the evap concentration coefficient $K_{evpcon}$ is not within the reference range (b), the program goes to S408 where it is judged whether or not the purge rate is being switched from the high purge rate $P_{RTOhi}$ to the low purge rate $P_{RTOlo}$. If YES, at S409 a predetermined decrement $\Delta P_{RTOlo}$ is subtracted from the present target purge rate $P_{RTO}$ so as to make a step-by-step adjustment from the high purge rate $P_{RTOhi}$ to the low purge rate $P_{RTOlo}$.

Further, at S410 it is judged whether or not the purge rate is equal to or smaller than the low purge rate $P_{RTOlo}$. If NO, the reduced purge rate becomes the present target purge rate (S411) and if YES, the low purge rate $P_{RTOlo}$ is established as the present target purge rate $P_{RTO}$. Thus, the target purge rate is reduced step-by-step until it reaches the low purge rate $P_{RTOlo}$.

On the other hand, if it is judged at S408 that the switching from $P_{RTOhi}$ to $P_{RTOlo}$ is finished (NO), that is, if it is judged that the low purge rate $P_{RTOlo}$ has been established already, at S412 the established purge rate $P_{RTOlo}$ is retained as it is.

As described above, since a step-by-step increase or decrease of the target purge rate is made at S404 or S409, the vehicle driveability at the change of the target purge rate is improved.

Figure 12:
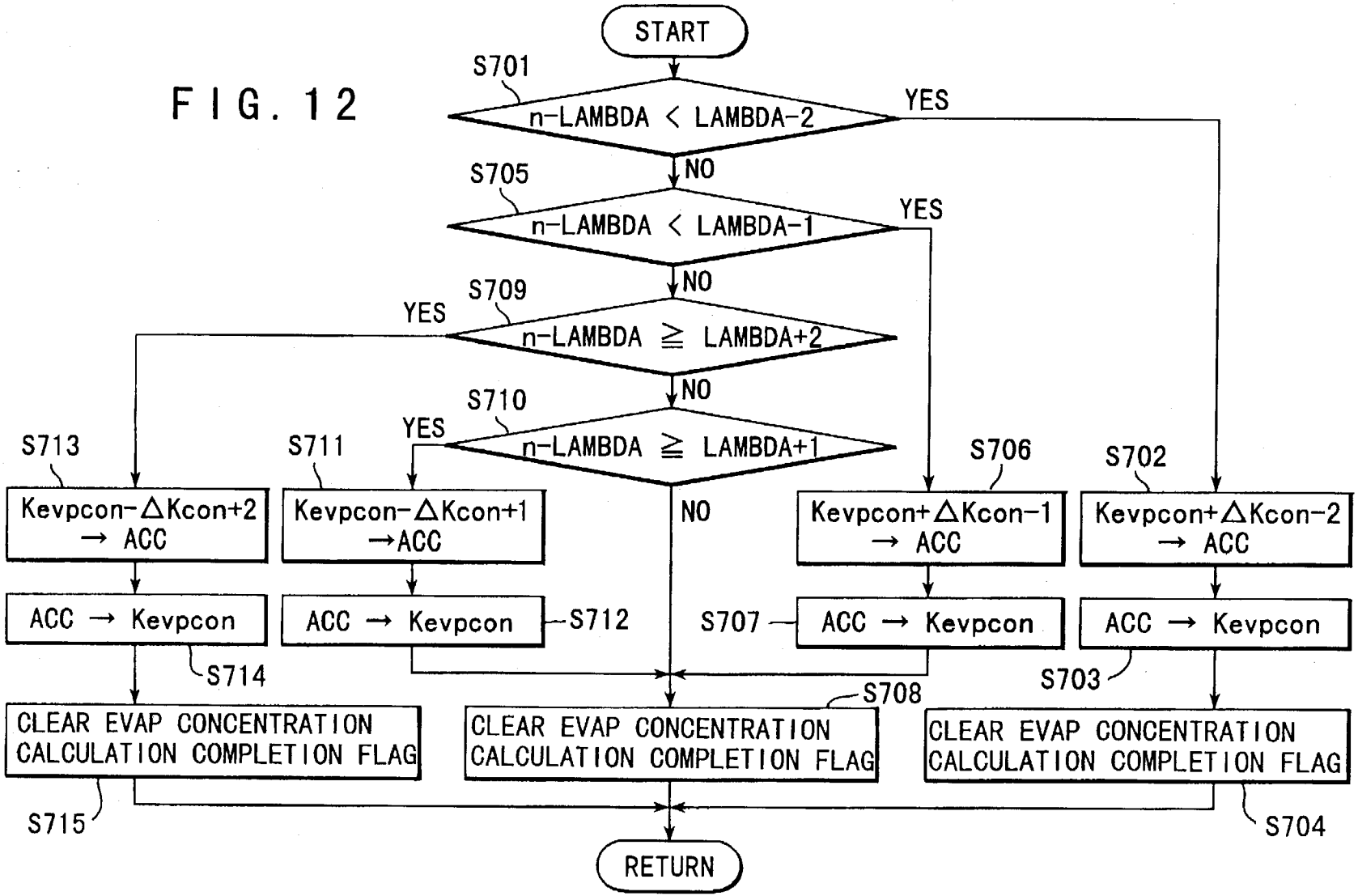
FIG. 12 is a flowchart showing a routine for calculating an evap concentration coefficient.

Referring to FIG. 8, this is a time chart showing the change of the target purge rate at the first and second stages. The target purge rate $P_{RTO}$ starts to increase at the purge starting time $t_1$ and when it reaches the specified value $P_{RTOok}$ (see S104, S206 and S304), the evap concentration calculating routine which will be described hereinafter in FIG. 12 is started at $t_2$. When the target purge rate $P_{RTO}$ is increased up to the low purge rate $P_{RTOlo}$ (a time $t_3$), that is, when the start processing is finished, the processing routine after the calculation of the evap concentration which is shown in FIG. 6 is executed. In this routine, the evap concentration coefficient $K_{evpcon}$ (described hereinafter) is compared with the specified reference values and according to the result of this comparison the high purge rate $P_{RTOhi}$ or the low purge rate $P_{RTOlo}$ is selected.

Figure 9:
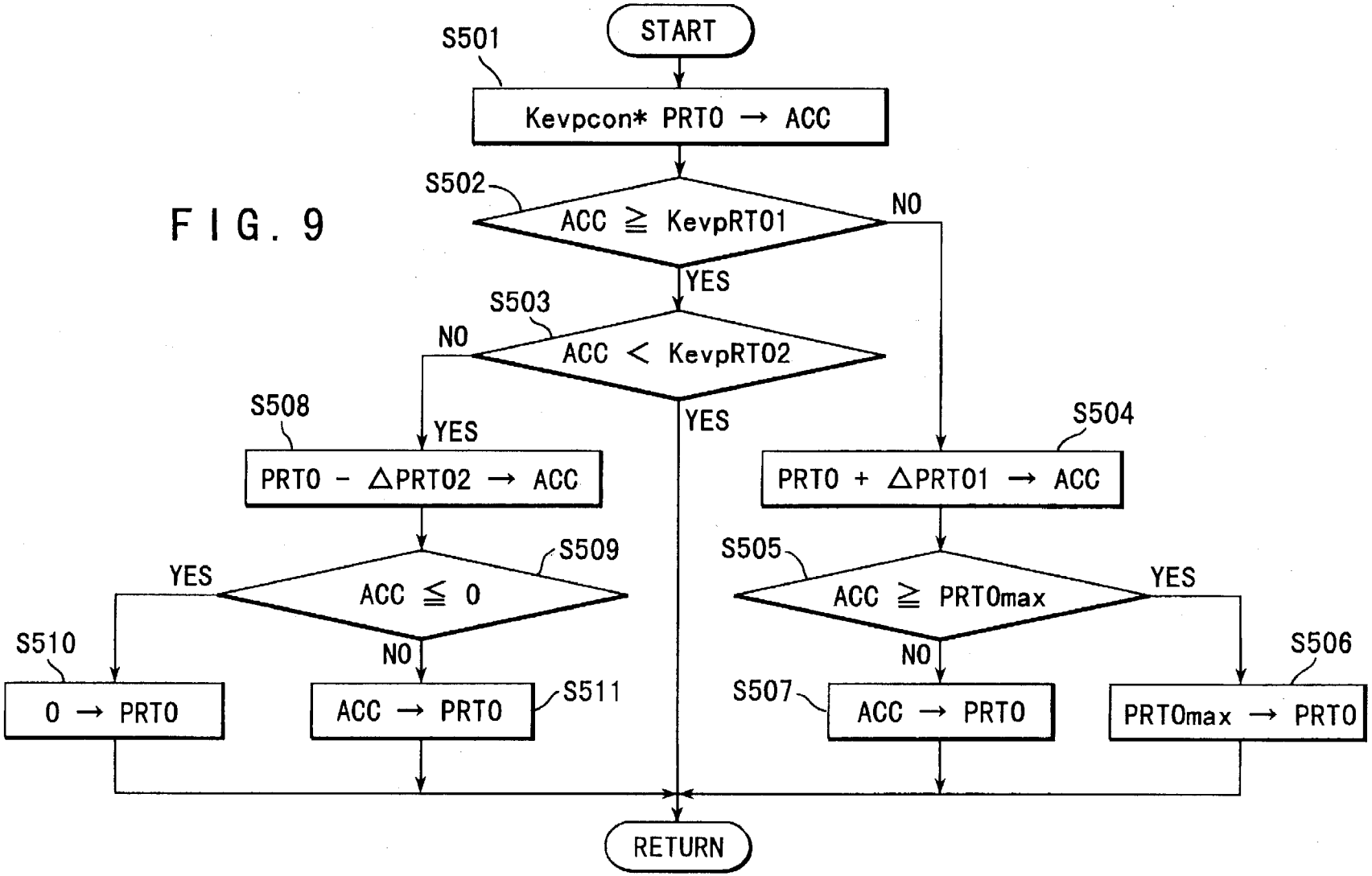
FIG. 9 is a flowchart showing a second example of a routine for calculating a target purge rate before the end of purging according to the present invention.

Next, FIG. 9 shows a second calculating routine of the target purge rate after the completion of the evap concentration calculation and before the purge stop. In this embodiment, the target purge rate is changed such that the product of multiplication of the evap concentration coefficient $K_{evpcon}$ by the target purge rate $P_{RTO}$ comes within a specified range.

First, at S501 the target purge rate is multiplied by the evap concentration coefficient $K_{evpcon}$. This target purge rate $P_{RTO}$ is a target purge rate produced at the immediately previous routine.

Next, at S502 it is judged whether or not the product of the multiplication is equal to or larger than a predetermined first target evap reference rate $K_{evpRTO1}$. If YES, at S503 it is further judged whether or not the product is smaller than a predetermined second target evap reference rate $K_{evpRTO2}$. Namely, therein it is judged whether or not the product of the multiplication of the evap concentration coefficient by the target purge rate is within a specified range. If the product of multiplication does not come within the specified range, the target purge rate $P_{RTO}$ (its initial value is the start maximum purge rate $P_{RTOlo}$) is changed and adjusted so as to come within that specified range.

Figure 10:
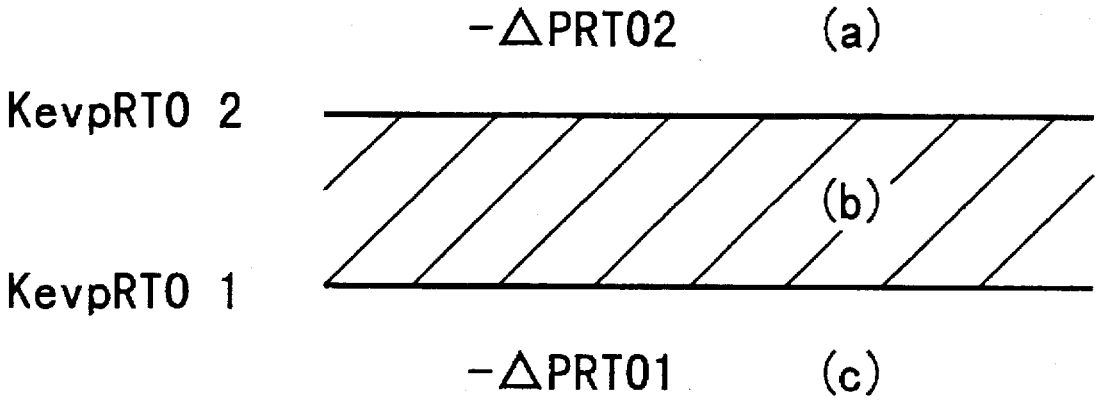
FIG. 10 is a chart showing an area for selecting a target purge rate.

First, at S502 if it is judged that the product of multiplication does not reach the first target evap reference rate (NO), that is, in case where the product of multiplication is located at a area (c) of the target evap reference rate KPTO as shown in FIG. 10, at S504 the present purge rate PRTO is added by a specified increment $\Delta P_{RTO1}$ and the product of addition is stored as ACC. Further, at S505 it is judged whether or not the product of addition is equal to or larger than a specified maximum value $P_{RTOmax}$. If YES, at S506 that maximum value $P_{RTOmax}$ is established as the present target purge rate $P_{RTO}$. If NO, at S507 the product of addition is established as the present target purge rate $P_{RTO}$.

On the other hand, if it is judged at S502 that the product of multiplication as mentioned above is larger than the first target evap reference rate $K_{evpRTO1}$ and if it is judged at S503 that it is smaller than the second target evap reference rate $K_{evpRTO2}$, that is to say, in case where it is located at a range (b) of FIG. 10, the program is returned to START without changing the present target purge rate.

If it is judged at S503 that the product of multiplication has reached the second target evap reference rate $K_{evpRTO2}$, the program goes to S508 where the present target purge rate $P_{RTO}$ is subtracted by a predetermined decrement $P_{RTO2}$ and the product of subtraction is stored as ACC. Further, at S509 it is judged whether or not the stored product of subtraction is equal to or smaller than an initial value. In FIG. 9, the initial value "0" means the start maximum purge rate $P_{ROlo}$ which is an initial value of this routine. If YES, the program goes to S510 where that initial value is set to the target purge rate $P_{RTO}$.

On the other hand, if NO at S509, the product of subtraction is established as the target purge rate $P_{RTO}$ at S511. Thus, according to this embodiment, since the target purge rate is established properly taking the evap concentration into consideration and further it is changed by bits step-by-step, there is a small effect of the purge control on the vehicle driveability.

Figure 11:
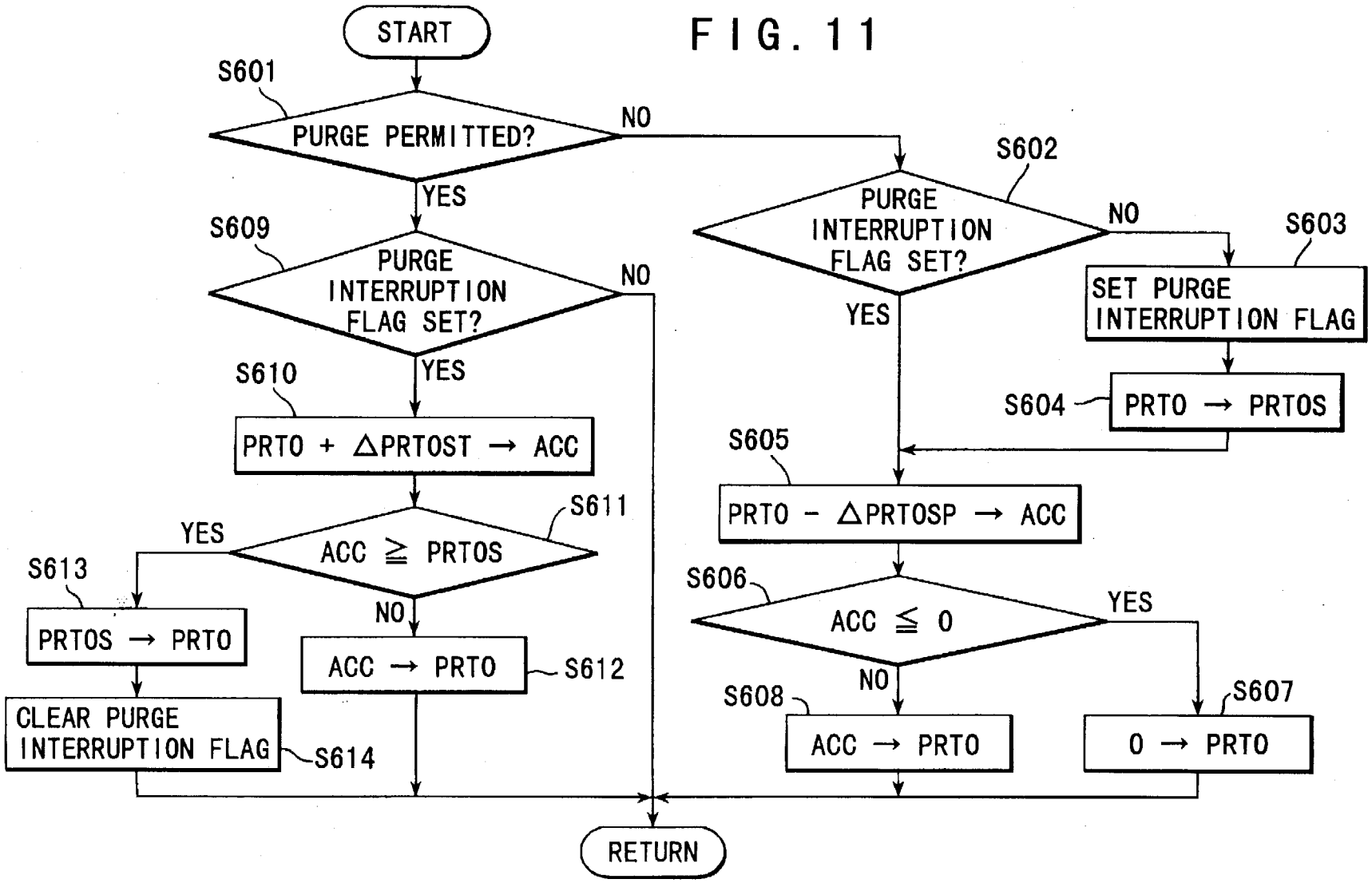
FIG. 11 is a flowchart showing a routine for calculating a target purge rate when purging is restarted.

Next, FIG. 11 indicates a calculating routine of the target purge rate after the calculation of the evap concentration is started (time $t_2$ shown in FIG. 8).

First, at S601 it is judged whether or not the purge permission condition is satisfied. In case where the condition is not satisfied, that is, in case where the purge stop is required, it is judged at S602 whether or not a purge stop flag has already set. If the purge stop flag has not set (NO), at S603 the flag is set and at S604 the present target purge rate $P_{RTO}$ is stored in the memory as a stop target purge rate $P_{RTOS}$.

In case where it is judged at S602 that the purge stop flag has been set, that is, in case where it is judged that the purge stop flag has already set by the processings at S603 and S604 (YES), at S605 a decrement $\Delta P_{RTOSP}$ for gradually reducing the purge rate is subtracted from the present purge rate $P_{RTO}$ and the product of subtraction is stored as ACC. Further, at S606 it is judged whether or not this stored value is smaller than 0. If it is smaller than 0 (YES), the program goes to S607 where the target purge rate is set to 0 and as a result of this, the purge operation is stopped.

On the other hand, in case where ACC is not smaller than 0 at S606 (NO), at S608 the purge rate stored as ACC is set to the present purge rate $P_{RTO}$. Thus, after the purge stop flag is set, the target purge rate is reduced step-by-step to stop.

Next, in case where it is judged at S606 that the purge permission condition is satisfied (YES), further it is judged at S609 whether or not the purge stop flag is set. If it is not set, the program is returned to START and the normal target purge rate calculation routine is executed. On the other hand, if the purge stop flag is set (YES), it is understood that the purge has been in the stop condition and the purge restarting condition is satisfied. In this case, at S610 the purge rate $P_{RTO}$ which is currently equal to 0 is added by the increment $\Delta P_{RTOST}$ and the product of the addition is stored as ACC. This increment $\Delta P_{RTOST}$ is for setting back the target purge rate to the stop target purge rate $P_{RTOS}$ which was stored at the purge stop.

Further, it is judged at S611 whether or not the present purge rate stored as ACC as a result of the addition is equal to or larger than the stop target purge rate $P_{RTOS}$ and if it is smaller than $P_{RTOS}$ (NO), at S612 the present ACC is established as the target purge rate $P_{RTO}$. On the other hand, if YES, at S613 the stop target purge rate $P_{RTOS}$ is established as the target purge rate and at S614 the purge stop flag is cleared. As a result of this, when the purge is restarted, the target purge rate is set back to the one at the purge stop and the purge stop flag is cleared. Then, the program is transferred to the normal target purge rate calculation routine. Thus, since at the purge stop the target purge rate is adjusted so as to be step-by-step reduced up to 0 and at the purge restarting the purge rate is adjusted so as to be step-by-step increased up to the stop target purge rate, at the purge stop, a smooth controllability is secured and at the purge restarting, a quick recovering operation and a smooth controllability are achieved.

In aforementioned embodiments, after the flag for permitting the evap concentration calculation is set, the feed-forward correction of the fuel injection amount is made by the evap correction means. The calculation of the fuel injection amount is performed according to the following formula:

$$T_e = T_p * (COEF * LAMBDA - K_{evpcon} * P_{RTOR})$$

where $T_e$ is an effective fuel injection pulse width; $T_p$ is a basic fuel injection pulse width; COEF is a fuel injection amount correction coefficient; LAMBDA is a feedback correction coefficient; $K_{evpcon}$ is an evap concentration coefficient (=Φ−1 (Φ denotes an evap equivalent ratio which is normally larger than 1)); and $P_{RTOR}$ is an actual purge rate (=$P_{VRTO}$*$P_{RTO}$). For the simplification of the control, the stop target purge rate $P_{RTOS}$ may be used as it is.

That is to say, in the evap correction means the fuel injection amount correction for evap is made by reducing a multiplication product of the evap concentration coefficient and the actual purge rate from a multiplication product of the fuel injection amount correction coefficient and the feedback correction coefficient. This fuel injection amount correction for evap is made after the flag for permitting evap concentration calculation is set and the evap concentration coefficient is produced by calculation.

Next, an evap concentration coefficient calculation routine for calculating the evap concentration coefficient Kevpcon will be described with reference to FIG. 12. This routine is carried out for every embodiment described before.

Figure 13:
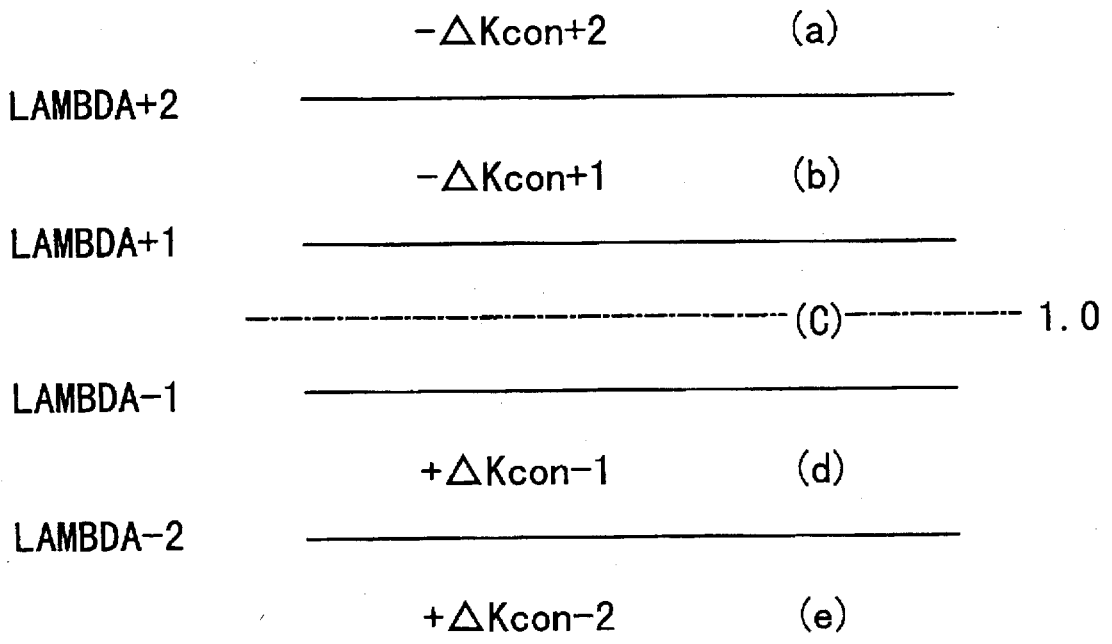
FIG. 13 is an explanatory drawing showing an area of a feedback correction coefficient.

First, at S701 it is judged whether or not a first-order delay value n-LAMBDA of the feedback correction coefficient LAMBDA is smaller than a reference value LAMBDA-2 which is less than 1.0 as shown in FIG. 13. If YES, that is, if n-LAMBDA is located in an area (e), the program goes to S702 where a larger increment $\Delta K_{con-2}$ is added to the present evap concentration coefficient $K_{evpcon}$ so as to set back this first-order delay value n-LAMBDA to 1.0 and the addition is stored as ACC. Further, at S703 this stored value is established as a new evap concentration coefficient $K_{evpcon}$. After that, at S704 an evap concentration calculation finishing flag is cleared. The above first-order delay value of the feedback correction coefficient LAMBDA is obtained for example as follows: obtain maximum and minimum values of the feedback correction coefficient LAMBDA each time the air-fuel ratio is transferred from rich to lean or vice versa and average these maximum and minimum values respectively, then producing a weighted averaging of them, applying "annealing process". This first-order delay value can be applied not only to the $O_2$ sensor shown in the present invention but also to a wide-range air-fuel ratio sensor.

If it is judged at S701 that n-LAMBDA is not smaller than LAMBDA-2 and it is judged at S705 that n-LAMBDA is smaller than a reference value LAMBDA, that is, in case where n-LAMBDA is located within an area (d) in FIG. 13, the program skips to S706 where a smaller increment $\Delta K_{con-1}$ is added to the present evap concentration coefficient $K_{evpcon}$ and the product of addition is stored as ACC. Then, at S707 the stored value of ACC is established as a new evap concentration coefficient Kevpcon and at S708 the evap concentration calculation finishing flag is set. The evap concentration calculation finishing flag thus set enables to proceed the target purge rate calculating routine as shown in FIG. 6 and FIG. 9.

If it is judged at S705 that the first-order delay value n-LAMBDA is not smaller than the reference value LAMBDA-1 (NO), the program goes to S709 where it is judged whether or not the first-order delay value n-LAMBDA is larger than a larger reference value LAMBDA+2 shown in FIG. 13. If NO, that is, in case where n-LAMBDA is not located in an area (a), then at S710 it is judged whether or not n-LAMBDA is larger than a reference value LAMBDA+1 which is larger than 1.0 and smaller than the LAMBDA+2. If larger than LAMBDA+1 (located in an area (b)), at S711 a smaller decrement $\Delta K_{con+1}$ is reduced from the evap concentration coefficient $K_{evpcon}$ and the product of reduction is stored as ACC. Further, at S712 the stored value of ACC is established as the present evap concentration coefficient $K_{evpcon}$ and at S708 the evap concentration calculation finishing flag is set.

On the other hand, if YES at S709, that is, in case where n-LAMBDA is located in an area (a), the program goes to S713 where a larger decrement $\Delta K_{con+2}$ is reduced from the evap concentration coefficient $K_{evpcon}$ and the product of reduction is stored as ACC. Further, at S714 the stored value is established as the present evap concentration coefficient $K_{evpcon}$ and at S715 the evap concentration calculation finishing flag is cleared.

Finally, it is judged at S710 that the first-order delay value n-LAMBDA is not larger than the reference value LAMBDA+1 (NO), that is, in case where the judgment is NO at S701, S705, S709 and S710, that is, n-LAMBDA is located within an area (c) in FIG. 13, the present evap concentration coefficient is used as it is and at S708 the evap concentration calculation finishing flag is set.

The evap concentration coefficient calculating routine shown in FIG. 12 employs the feedback correction coefficient LAMBDA obtained while the correction of the fuel injection amount is made by the product of multiplication of the actual purge rate $P_{RTOR}$ and the evap concentration coefficient. Consequently, the calculation of evap concentration on the basis of the first-order value of such feedback correction coefficient LAMBDA can be made more accurate.

In summary, according to the purge control system of the present invention, since the target purge rate is established properly on every stage from the purge starting to the purge stop or from the purge stop to the purge restarting, the lowering of the controllability of the air-fuel ratio control due to the purge control can be prevented with the utmost evap purge amount retained.

Further, after the evap concentration is calculated, since the target purge rate is established, securing the smoothness of the change of the purge rate, the evap purge control having a smooth controllability in the transient condition can be achieved.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A fuel vapor purge control system of an engine equipped with an air-fuel ratio sensor for producing an air-fuel ratio signal relating to an air-fuel ratio of said engine and an air-fuel ratio feedback control system for calculating a feedback correction coefficient to be applied to the calculation of a fuel injection amount based on said air-fuel ratio signal, the system having, a fuel tank, a carbon canister for storing fuel vapor generated in said fuel tank, and a purge valve provided to control a purge rate of the purge flow from said canister to said engine, comprising:

fuel vapor concentration calculating means for calculating a concentration of fuel vapor in the purge flow based on said feedback correction coefficient;

target purge rate calculating means for selectively setting a target purge rate depending on the magnitude of said fuel vapor concentration; and purge valve controlling means for controlling the operation of said purge valve so as to obtain said target purge rate.

2. The fuel vapor purge control system according to claim 1, wherein said target purge rate calculating means sets a first target purge rate when said fuel vapor concentration is within a predetermined range and sets a second target purge rate smaller than said first target purge rate when said fuel vapor concentration is outside said predetermined range.

3. The fuel vapor purge control system according to claim 2, wherein said target purge rate calculating means varies a target purge rate when shifting between said first and second target purge rate.

4. The fuel vapor purge control system according to claim 1, further comprising:

purge condition judging means for judging whether or not a purge condition to perform purging is satisfied based on operational conditions of said engine, wherein said target purge rate calculating means sets an initial target purge rate after said purge condition judging means judges that said purge condition is satisfied, said initial target purge rate being gradually increased with an elapse of time from an initial rate to a predetermined rate, and then sets a target purge rate depending on said fuel vapor concentration after said initial target purge rate reaches said predetermined rate.

5. The fuel vapor purge control system according to claim 4, wherein said target purge rate calculating means increases said initial target purge rate with the increase of an accumulated value of intake air amount of said engine after the purge starts.

6. The fuel vapor purge control system according to claim 4, wherein said target purge rate calculating means increases said initial target purge rate when said feedback correction coefficient is transferred from rich to lean.

7. The fuel vapor purge control system according to claim 4, wherein said target purge rate calculating means decreases a target purge rate to zero to stop purging when said purge condition judging means judges that said purge condition is not satisfied, and memorizes a target purge rate at the moment when the purge condition is not satisfied, to resume when the purge condition is satisfied again.

8. The fuel vapor purge control system according to claim 1, further comprising:

correction means for correcting the fuel injection amount by reducing an amount equivalent to a purged fuel vapor amount calculated based on said fuel vapor concentration and said target purge rate.

9. A fuel vapor purge control system of an engine equipped with an air-fuel ratio sensor for producing an air-fuel ratio signal relating to an air-fuel ratio of said engine and an air-fuel ratio feedback control system for calculating a feedback correction coefficient to be applied to the calculation of a fuel injection amount based on said air-fuel ratio signal, said system having a fuel tank, a carbon canister for storing fuel vapor generated in said fuel tank, and a purge valve provided to control a purge rate of the purge flow from said canister to said engine, comprising:

fuel vapor concentration calculating means for calculating a concentration of fuel vapor in the purge flow based on said feedback correction coefficient;

target purge rate calculating means for controlling a target purge rate such that a product of multiplication of said fuel vapor concentration and said target purge rate is within a predetermined control range; and purge valve controlling means for controlling the operation of said purge valve so as to obtain said target purge rate.

10. The fuel vapor purge control system according to claim 9, wherein said target purge rate calculating means gradually varies a target purge rate toward either higher or lower limit whenever said product of multiplication of said fuel vapor concentration and said target purge rate is outside said predetermined control range.

11. The fuel vapor purge control system according to claim 9, further comprising:

purge condition judging means for judging whether or not a purge condition to perform purging is satisfied based on operational conditions of said engine, wherein said target purge rate calculating means sets an initial target purge rate after said purge condition judging means judges that said purge condition is satisfied, said initial target purge rate being gradually increased with an elapse of time from an initial rate to a predetermined rate, and then sets a target purge rate depending on said fuel vapor concentration after said initial target purge rate reaches said predetermined rate.

12. The fuel vapor purge control system according to claim 11, wherein said target purge rate calculating means increases said initial target purge rate with the increase of an integrated value of intake air amount of said engine after the purge start.

13. The fuel vapor purge control system according to claim 11, wherein said target purge rate calculating means increases said initial target purge rate when said feedback correction coefficient is transferred from rich to lean.

14. The fuel vapor purge control system according to claim 11, wherein said target purge rate calculating means decreases a target purge rate to zero to stop purging when said purge condition judging means judges that said purge condition is not satisfied, and memorizes a target purge rate at the moment when the purge condition is not satisfied, to resume when the purge condition is satisfied again.

15. The fuel vapor purge control system according to claim 9, further comprising:

correction means for correcting the fuel injection amount by reducing an amount equivalent to a purged fuel vapor amount calculated based on said fuel vapor concentration and said target purge rate.

* * * * *